US005915572A

United States Patent [19]

Hancock

[11] Patent Number: 5,915,572

[45] Date of Patent: Jun. 29, 1999

[54] RIFLE SUPPORT RACK

[75] Inventor: Dennis Hancock, 5752 N. Silverstone Cir., Mountain Green, Utah 84050

[73] Assignees: Dennis Hancock, Mt. Green; George Gates, South Jordan, both of Utah

[21] Appl. No.: 08/580,132

[22] Filed: Dec. 28, 1995

[51] Int. Cl.[6] ..... A47F 7/00

[52] U.S. Cl. ..... 211/64; 248/222.12

[58] Field of Search ..... 211/64, 89, 70.6, 211/60.1, 70.5; 224/913; 248/222.12

[56] References Cited

U.S. PATENT DOCUMENTS

| | | | |
|---|---|---|---|
| 3,063,569 | 11/1962 | Huber | 211/89 |
| 3,096,960 | 7/1963 | Kinney . | |
| 3,361,265 | 1/1968 | Wernimont . | |
| 3,365,761 | 1/1968 | Kalvig . | |
| 4,325,484 | 4/1982 | Berry | 211/70.8 |
| 4,597,496 | 7/1986 | Kaplan | 211/89 |
| 4,607,772 | 8/1986 | Hancock . | |
| 4,691,887 | 9/1987 | Bessinger . | |
| 4,776,471 | 10/1988 | Elkins | 211/64 |
| 5,078,279 | 1/1992 | Hancock et al. . | |
| 5,275,367 | 1/1994 | Frye . | |
| 5,344,032 | 9/1994 | Ramsdell . | |
| 5,524,772 | 6/1996 | Simmons | 211/87 |

FOREIGN PATENT DOCUMENTS

| | | | |
|---|---|---|---|
| 1040333 | 8/1966 | United Kingdom | 211/64 |

*Primary Examiner*—Ramon O. Ramirez
*Assistant Examiner*—Anita M. King
*Attorney, Agent, or Firm*—Thorpe, North & Western

[57] ABSTRACT

A support rack for holding rifles and the like includes a generally U-shaped frame having a liner disposed thereon. A plurality of fins extend inwardly from the liner so as to engage a rifle stock disposed in the frame. The fins are sufficiently flexible to conform to the shape of the stock, and sufficiently resilient to hold the stock in place. By maximizing the surface area of the fins disposed in contact with the stock, the ability of the fins to frictionally engage the stock is increased. The fins retain the stock sufficiently that straps and other prior art retention devices will be generally unnecessary.

21 Claims, 4 Drawing Sheets

RIFLE SUPPORT RACK

BACKGROUND OF THE INVENTION

1. Field of the Invention

The present invention relates to rifle holding devices which can be mounted in the rear of a truck cab, and in particular, to a rifle support rack which has a plurality of fins disposed thereon to hold a rifle firmly and securely within the rack without the need for a retaining strap.

2. Prior Art

The use of racks to hold rifles and other sporting equipment, such as bows, fishing rods, etc, is well known. Typically, racks used to hold sporting equipment include a generally U-shaped body for receiving a portion of the stock, and a strap attachable to both sides of the U-shaped body and positionable over the portion of the stock. The strap serves to hold the stock within U-shaped body and prevent accidental removal.

When hunting, people usually go to remote locations which are often far from any regularly maintained roads. To travel to the desire location, a four wheel drive vehicle is often used. Frequently, the four wheel drive vehicle is a pick-up truck. In most pick-up trucks, the most convenient place to hold the rifles to be used during the hunting trip is at the back of the cab behind the heads of the occupants. However, because the vehicle will often be bouncing over rough roads, a strap is used to hold the stock of the rifle within the U-shaped body. See e.g. U.S. Pat. Nos. 5,078,279 and 5,344,032.

In accordance with the teachings of the prior art, it has been believed that failure to include a strap was dangerous. If a rifle were placed in the U-shaped body without a strap, any sudden bump could cause the rifle to bounce out of the holding device. Because the rifle is disposed behind the heads of the vehicle's occupants, the unattached rifle would likely hit the occupants in the head. With large rifles, the force involved due to a large bump could be sufficient to render a person unconscious. Thus, by providing straps, the prior art has attempted to prevent such accidents from occurring.

A problem with straps is that they limit the access of the user to the rifle. Thus, for example, if a hunter sees the desired game from the road, he or she must turn to remove the straps so that the rifle can be removed from the rack. Once the rifle is in hand, the hunter must then exit the truck and relocate the game. Those familiar with hunting will realize that this is often difficult, as the game may have moved. Likewise, for game which blends in with the surrounding foliage, the hunter will often notice the game because of movement. However, once he or she loses sight of the game, it will be difficult to relocate due to its similarity with its surroundings.

Yet another problem with the presently available racks for mounting in trucks is that the straps are occasionally difficult to remove. This is especially true when the hands of the hunter are cold, as is often the case during fall and winter hunting seasons. To further complicate matters, the strap may be frayed twisted or otherwise difficult to unlatch.

For these reasons, a hunter might unlatch the strap upon entering the hunting area. However, this is dangerous as the rifle might jar lose and strike the hunter in the back of the head if the truck encounters a sudden obstruction in the road.

One exception to the prior art teachings of straps to hold the rifle in the support rack is disclosed in U.S. Pat. No. 4,607,772. The rack in this patent is designed to fit a motorcycle adjacent the handle bars. Because motorcycles are generally not used for extremely rough roads (especially when carrying a rifle), and because a rifle mounted adjacent the handle bars can easily be steadied by the rider, the patent teaches a rifle support which has a utility holding device with resilient caps and an angled upper end. Once the rifle is in place, the holding devices are turned to lock the devices into forceful engagement with the rifle. In the alternative to rubber caps, FIG. 4 of the patent shows an embodiment with an upper end which substantially completes a loop, and an embodiment in which a number of plastic finger-like projections maintain contact with the rifle as the generally U-shaped utility devices are rotated into forceful contact with the rifle. As will be appreciated by those skilled in the art, this rotatable engagement would generally be impractical in a truck and the back window of the cab would interfere with rotation and would require the person removing the rifle to turn into a position not normally assumed in the truck cab.

To overcome the disadvantages associated with the prior art, there is a need for a device which securely holds the rifle when held in a rack, but which does not require the use of a strap or the use of rotatable support devices. Such a device should allow the user to easily remove the rifle without looking, but retain the rifle securely as the truck passes over uneven terrain.

SUMMARY OF THE INVENTION

Thus, it is an object of the present invention to provide an improved support rack for securely holding an elongate member, such as a rifle, without interfering with access to the rifle.

It is another object of the present invention to provide a support rack which can securely hold a rifle without requiring the rifle to be strapped into the support rack.

It is another object of the present invention to provide such a support rack which cushions the rifle contained therein against being scratched or damaged, and inhibits accidental removal of the rifle from the support rack.

The above and other objects of the invention are realized in specific illustrated embodiments of a rifle support rack including a generally U-shaped frame formed by upwardly extending arms and a rounded bottom joined to the arms so as to define a containment area. Each arm and the bottom have an inner face about the containment area which is coated with a soft and resilient material. This may be a liner attached to the frame, or a sheath which slides over the frame. It is preferred that the liner prevent contact between the rifle and the frame, thereby limiting marring of either one by the other.

Extending into the containment area from the frame are a plurality of fins. The fins are typically disposed on the upwardly extending arms of the U-shaped frame formed from the resilient materials. The fins are made from a rubber-like or elastomeric material to enhance friction when the rifle is disposed in the U-shaped frame. The fins are generally disposed in such a way that as the stock of the rifle is slid into the U-shaped frame, the fins bend and conform to the shape of the stock. The rubber-like material, by being frictionally engaged with the stock, inhibits the ability of the rifle to be inadvertently released from the U-shaped frame by a sudden force or impact.

In accordance with the principles of the present invention, each of the fins includes a broadly rounded or substantially flat end opposite the resilient inner face of the U-shaped frame. As a midportion of one or more of the fins frictionally engages the stock of the rifle to inhibit withdrawal, the broad ends of the fins rest against the side of stock and are pushed against the stock by the midportion of the fin below. If a sudden jar begins to move the stock out of the U-shaped frame, the broad ends of the fins will nest in any groove or indentation in the stock, and catch on any textured surface, thereby interfering with the stock's ability to move out of the frame.

While the fins significantly interfere with the ability of the rifle to be jarred loose from the U-shaped frame, the rifle may be removed from the frame with a firm lifting motion. Thus, a hunter need not look at the support rack and loosen the straps.

In accordance with another aspect of the invention, each of the fins has a length and a width. The width of each fin is at least as great as its length and is preferably greater than the length. The broad fins maximize surface area which can frictionally engage the stock to maintain it within the containment area.

In accordance with yet another aspect of the invention, the U-shaped frame may be provided with retention devices for securing a strap. Thus, if the user will be traveling across extremely rough roads and does not intend on needing his or her rifle in a rapid manner, the strap may be applied to provide additional support. Once the user is in the vicinity of the desired hunting grounds, the straps may be removed so that the user will have ready access to the rifle. However, the danger to the hunter is reduced as the rifle will be held in place by the fins in the U-shaped frame.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Figure 1:
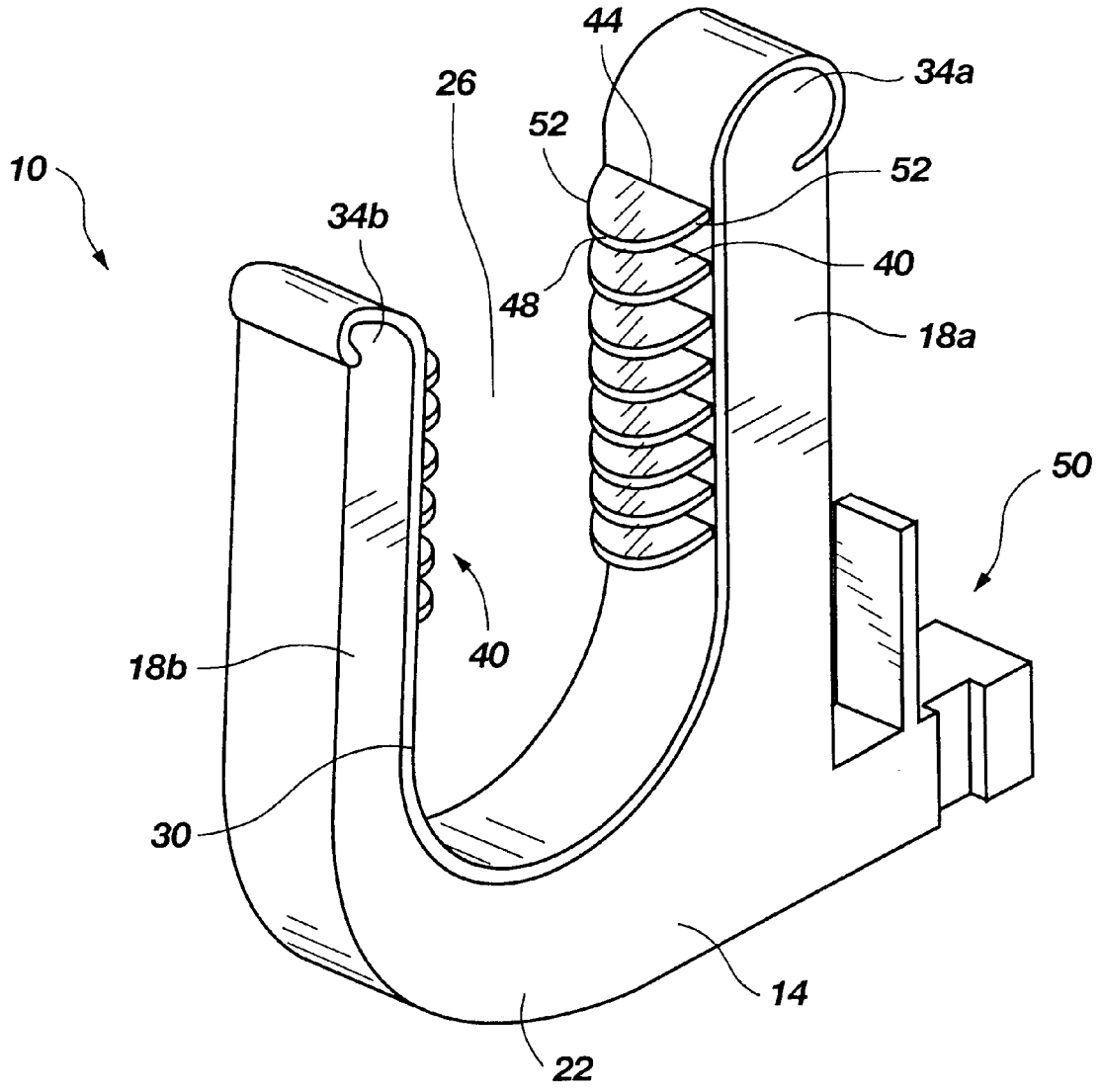
FIG. 1 shows a perspective view of a rifle support rack having a U-shaped frame member and a plurality of fins disposed therein.

Referring to FIG. 1, there is shown a perspective view of a rifle support rack, generally indicated at 10. The rifle support rack 10 includes a resilient, generally U-shaped frame 14 formed by two upwardly extending arms, 18*a* and 18*b* respectively, and a curved bottom/base 22. The arms 18*a* and 18*b* and the bottom/base 22 define a containment area 26 into which a portion of a rifle may be positioned. Those skilled in the art will recognize that what is commonly referred to as a U-shaped frame with respect to rifle supports can be shaped more like a V, or some similar configuration. For ease of discussion, U-shaped shall be used to refer to all U-shaped and V-shaped configurations which will be known to those skilled in the art.

Disposed between the generally U-shaped frame 14 and the containment area 26 is a liner 30. The liner 30 may extend upwardly and wrap over the upper ends 34*a* and 34*b*, respectively, of the arms 18*a* and 18*b*. In the alternative, the liner 30 may be formed as a sheath to substantially cover substantially all of the frame 14.

The liner 30 serves several purposes. First, by making the liner 30 out of a rubber-like material, a cushioning face is provided to the frame 14 so that it will not mar the stock of the rifle. Additionally, the relatively high frictional characteristics of the material inhibit the rifle from sliding once placed within the rifle support rack 10.

Disposed along the liner 30 are a plurality of fins 40 which are also made of a high friction, rubber-like material. It is presently believed that a thermo-plastic elastomer, such as SANTOPREME (sold by Advanced Elastomer Systems, Akron, Ohio) are preferred. The fins 40 project from the liner 30 into the containment area 26 and are sufficiently flexible to bend when a rifle is introduced into the containment area. As will be explained in additional detail below, the fins 40 form a unique method for retaining a rifle within the containment area 26.

Each fin 40 is attached at a first end 44 to the liner 30. The opposing second end 48 is generally broadly rounded the purpose for which is discussed in detail below. The second end 48 is generally broadly rounded within the plane of the substantially flat face 47 of the fin 40. The rounded second end 48 is formed between the lateral sides 52 of the fin 40. The rounded second end 48 may form the lateral sides 52. The broadly rounded end 48 of the fin 40 has a diameter greater than the width of the fin 40 or is elliptical with the major diameter of the ellipse being greater than or equal to the width of the fin. The distance between the lateral sides 52 of each fin 40 will generally be equal to or greater than the distance from the first end 44 to the second end 48. This maximizes the surface area of the fins 40 available for frictional engagement with a rifle stock. The fins 40 are also generally positioned so that the first end 44 of each fin is slightly higher than the second end 48 of the fin, thus giving the fins a downward slope as they extend into the containment area.

Typically, there are between four and eight fins 40 on each generally vertical side of the containment area 26. Thus, the exact size and thickness of the fins may be modified depending on the number of fins desired.

Also shown in FIG. 1 is an attachment mechanism 50 which may be used to attach the support rack 10 to a structure mounted in the back of a truck. Those skilled in the art will appreciate that numerous such attachment mechanisms exist and could be used with the rifle support rack 10 of the present invention.

Figure 2:
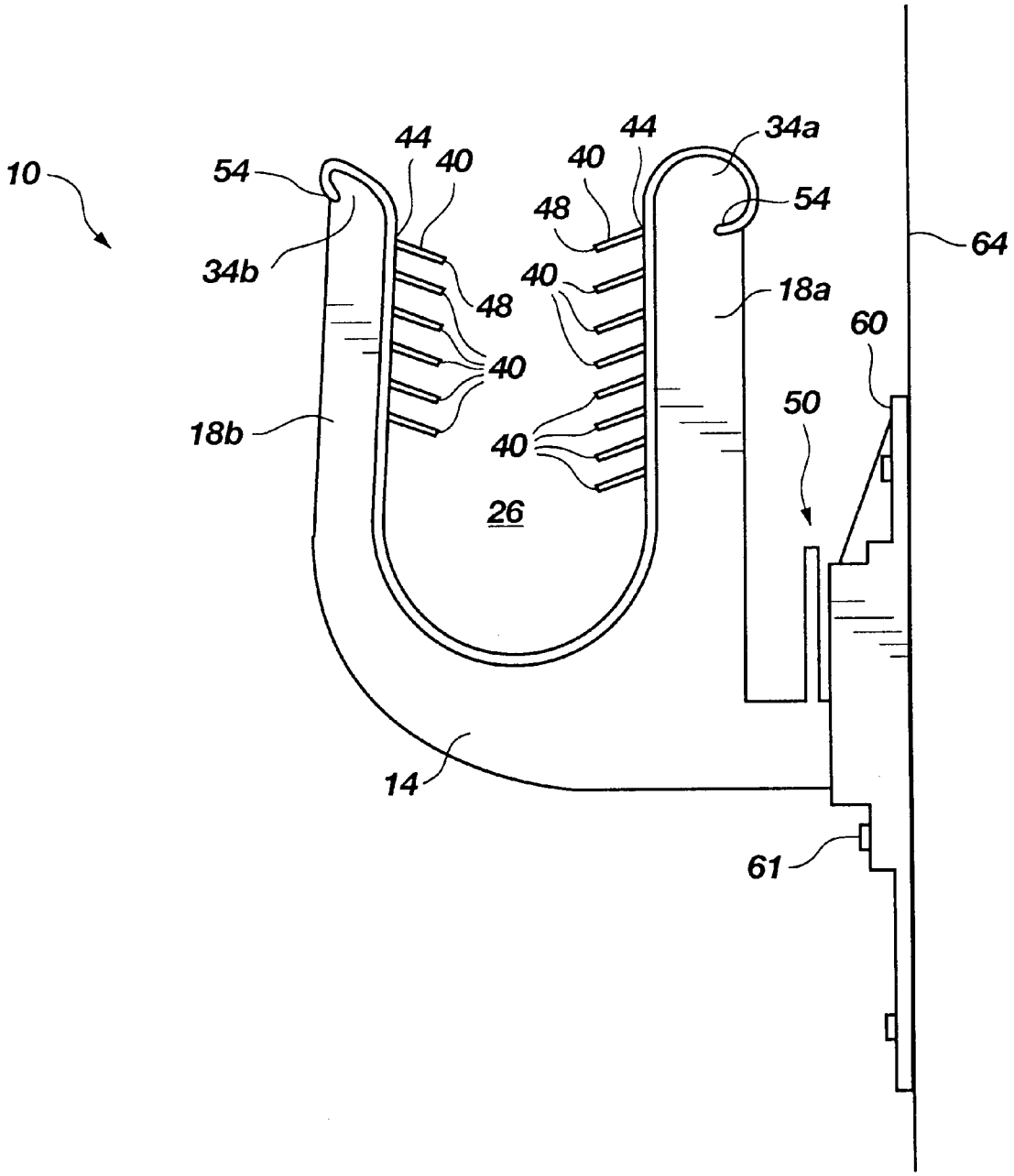
FIG. 2 shows an end view of the rifle support rack of the present invention as shown in FIG. 1.

Referring now to FIG. 2, there is shown an end view of the rifle support rack 10 made in accordance with the principles of the present invention. The support rack 10 includes the support frame 14 with upwardly extending arms 18*a* and 18*b*, and a rounded bottom/base portion 22. The liner 30 is secured by wrapping over the upper ends 34*a* and 34*b*, respectively, of the arms 18*a* and 18*b* and into a groove 54 formed therein. Numerous other methods for securing the liner 30 could be used.

The fins 40 which extend into the containment area 26 are disposed at a slight downward angle, i.e. the first end 44 is disposed above the second end 48, and are typically formed from a rubber-like, elastomeric material similar to that used for the liner 30. The fins 40 are usually spaced apart from one another a small enough distance that if the stock of a rifle is placed into the containment area 26, each fin 40 will bend so as to contact the next highest fin. This interrelationship is best shown in FIG. 3A.

As shown in FIG. 2, there need not be an even number of fins 40 on each side. Also the fins 40 can be of different widths. Thus, for example, there are eight fins 40 disposed adjacent arm 18*a* and the fins are all wider than they are long. On the opposing arm 18*b*, there are 6 fins 40, each of which is approximately the same length as those on arm 18*a*, but are of a width which is substantially the same as their length. Such fins 40, however, are still sufficiently broad to provide ample friction to inhibit accidental removal of the stock of a rifle from the containment area 26.

Also shown in FIG. 2 is the attachment mechanism 50 mounted in a base 60. The base 60 is attached to a wall 64, such as the back wall of a truck cab, by inserting tabs 61 within a receiving slot in accordance with interlock structure as disclosed in U.S. Pat. No. 5,078,279.

Figure 3:
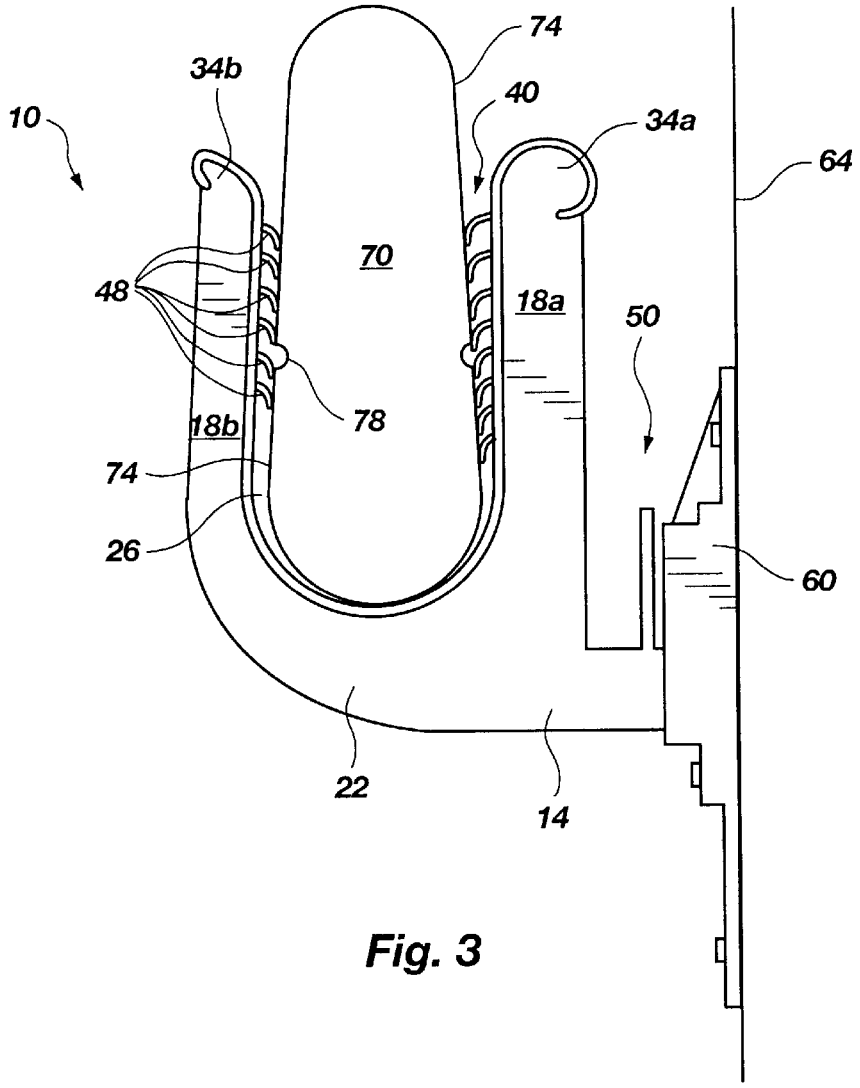
FIG. 3 shows the view of FIG. 2 with the stock of a rifle being disposed between the U-shaped arms of the rifle support rack.
Figure 3A:
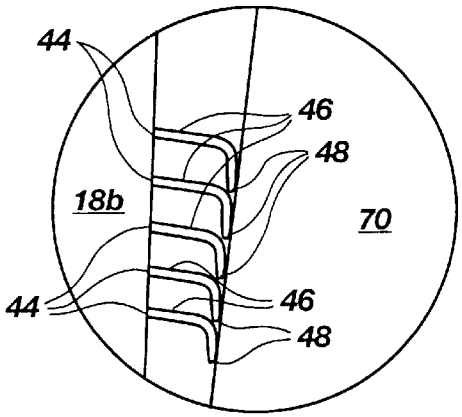
FIG. 3A shows a close-up view of a plurality of fins shown in FIG. 3.

Referring now to FIG. 3, there is shown a view similar to that of FIG. 2, the rifle support rack 10 having the stock 70 of a rifle disposed in the containment area 26. The rifle support rack 10 includes the arms 18*a* and 18*b*, the liner 30 and the fins 40 as described in FIG. 2. As the rifle stock 70 is slid into the containment area 26, the fins 40 of the support rack 10 bend along a midportion 46 (FIGS. 3A and 3B) to conform to the shape of the rifle stock 70. This midpoint is disposed along a substantially flat face 47 of the fins which faces generally toward the containment area 26 and engages the rifle stock 70. Once the rifle stock 70 is in the containment area 26, the fins 40 hold the stock in place and inhibit accidental removal from the containment area.

Because the fins 40 are formed of a rubber-like, elastomeric material, the fins conform to the side surfaces 74 of the stock 70 and tend to grip the stock to provide friction which is sufficient to inhibit its removal. The large width relative to the length maximizes the surface area which is available to frictionally engage the stock 70 and inhibit accidental withdrawal. The resilient nature of the fins 40 holds them in firm contact with the stock 70. Additionally, because of the spacing of the fins 40 discussed above, the broadly rounded second end 48 of each fin (except the bottom of each column) is held in contact with the stock 70 by the next lower fin. If the stock 70 is suddenly moved in an upward direction, the broadly rounded second ends 48 catch on any grooves or textured surface of the stock 70, such as the groove 78. By catching on such surfaces, the broadly rounded second ends 48 of the fins 40 require the stock 70 to move with sufficient force to fold the fins backward prior to withdrawal. As the stock 70 is withdrawn, the fins 40 continue to provide frictional resistance against the sides 74 of the stock.

By making the fins 40 between 1/12 and 1/32 of an inch thick, the fins are sufficiently flexible to conform to the shape of the rifle stock 70, yet sufficiently resilient to prevent accidental removal of the rifle without preventing removal when desired. To remove the rifle, the user need only apply continuous and firm upward pressure on the rifle until the stock 70 has slid out from between the fins 40. Because no straps are used, the user may remove the rifle conveniently without looking.

Referring now to FIG. 3A, there is shown a close-up view of the fins 40 which are bent along their midportion 46 so that the portion adjacent the second end 48 of each fin engages and conforms to the side 74 of the stock 70. By providing an elastomeric material having sufficient flexibility and resiliency, and by providing broad fins, an unexpectedly secure holding mechanism is achieved without the use of straps. The large surface area of each fin 40 at least partially engages the rifle stock to inhibit its withdrawal from the containment area.

Figure 3B:
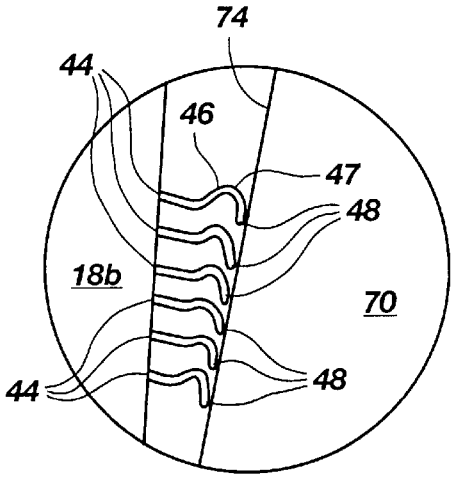
FIG. 3B shows a close-up view of the fins as a rifle stock is withdrawn from the containment area.

Referring now to FIG. 3B, there is shown a close-up view of the fins 40 and the side 74 of the stock 70 as the stock is being pulled free. Because the fins 40 are disposed at a downward angle into the containment area (not shown in FIG. 3B), each fin 40 must be pushed back towards its first end for the rifle stock 70 to be removed. Until a substantial portion of the fin 40 has passed beyond its axis defined by the original position of the fin, i.e. until the fin buckles, the fin will provide significant resistance to upward movement. Once this point has been passed, the force necessary to move the rifle stock upwardly is decreased.

Figure 4:
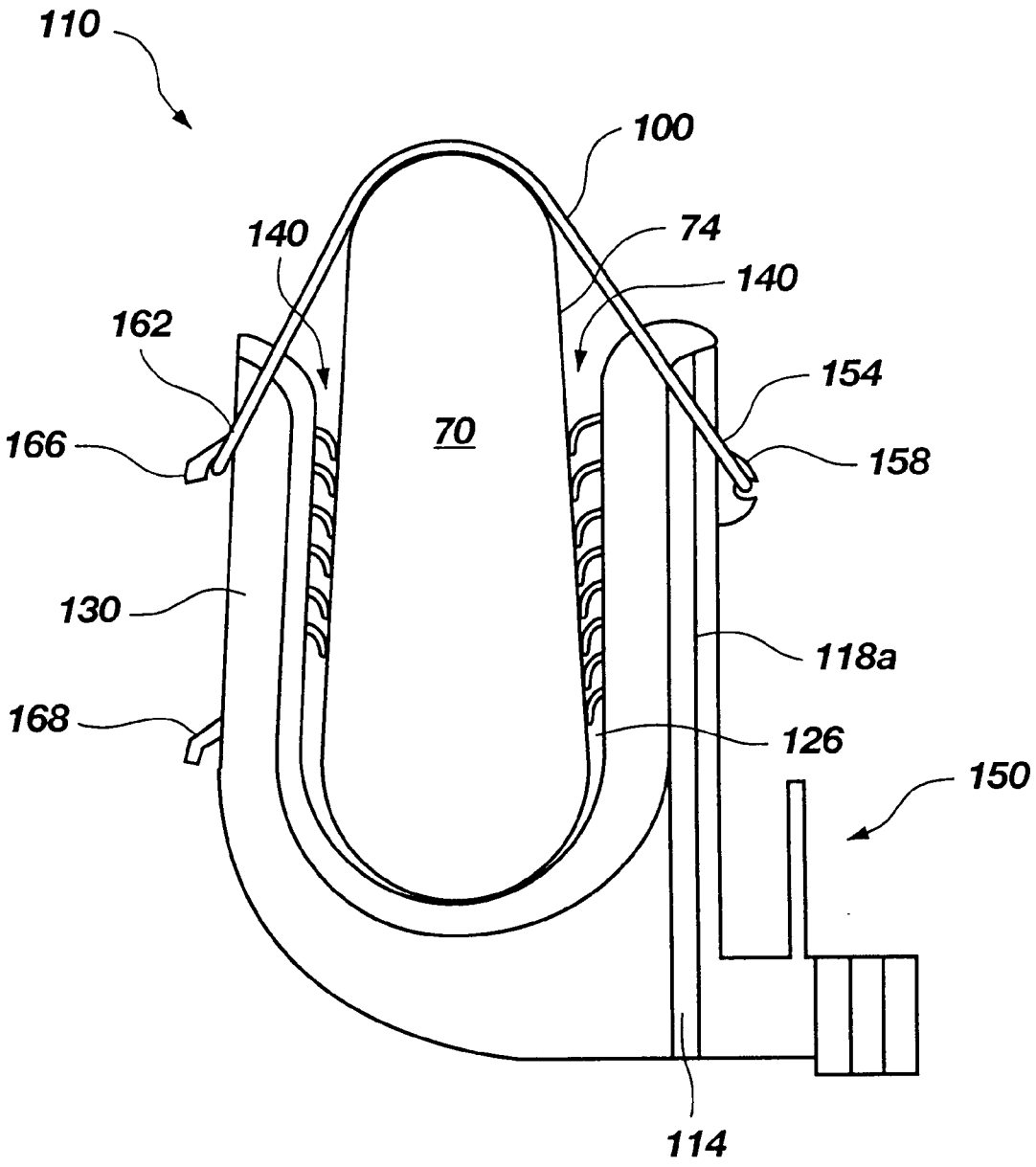
FIG. 4 shows an end view of an alternate embodiment of the invention, wherein the rifle support rack has a strap included with the rifle support rack to supplement the holding device of the present invention.

Referring now to FIG. 4, there is shown an alternate embodiment of the present invention in which a strap 100 is provided to prevent accidental removal of the rifle stock 70 from the support rack 110. The support rack has a frame 114 with upwardly extending arms, only one of which 118*a* is visible. The arms 118*a* and the bottom/base (not shown) are covered with a rubber-like, elastomeric liner in the form of a sheath 130. The sheath 130 protects the frame 114 from damage by guns and vice-versa.

Extending from the sheath 130 into the containment area 126 are a plurality of fins 140 formed in the manner discussed with respect to FIGS. 1 through 3B. The fins 140 engage the sides 74 of the rifle stock 70 to prevent accidental withdrawal, and to provide cushioning in the event that the support rack 110 is jarred during driving on rough roads. The support rack 110 is attached to the truck by the attachment mechanism 150.

The strap 100 provides added assurance that the stock 70 will not bounce out of the support rack 110 on very rough roads, but can be removed before entering the desired hunting area to ensure that the rifle is readily available. The strap 100 is attached at a first end 154 to an anchor 158 disposed on the visible arm 118*a*. An opposing second end 162 is wrapped about a hook 166 which extends through the sheath. A second hook 168 is provided at a lower position to enable the frame 114 to securely hold the barrel of a rifle.

While the strap 100 is generally not needed, it is beneficial for extreme conditions. Additionally, those who have grown accustomed to the prior art support racks may wish to have such a strap while testing the present invention. However, once the safety and convenience of the support rack of the present invention is experienced, it is anticipated that the use of a support strap with the same will be extremely rare.

Thus, there is disclosed an improved rifle support rack which enables the secure holding of a rifle without the need for a strap. Those skilled in the art will appreciate that numerous modifications can be made without departing from the scope or spirit of the invention. The appended claims are intended to cover such modifications.

What is claimed is:

1. A support rack for holding and cushioning a member, the support rack comprising:

a resilient U-shaped frame having a base portion and a pair of upwardly extending arms disposed so as to define a containment area;

a plurality of resilient, elastomeric fins, each fin having a first edge and a second, distal edge of greater length than the first edge, each fin being attached at the first edge to and disposed to extend inwardly from the frame into the containment area, each fin having a midportion between the attached first edge and the second, distal edge of greater length which includes a substantially flat face exposed toward the containment area, a fin thickness defined by the flat face and an opposing side of the fin, and a width defined by the first edge of the fin, the width being greater than the fin thickness, the fins being sufficiently thin and flexible at the midportion and being sized and dimensioned so that upon insertion of said member into the containment area, said midportions of said fins are diplaced to form a substantially continuous gripping surface in contact with said member to secure the member in a contained and cushioned position in the containment area.

2. The support rack of claim 1, wherein the second, distal end is broadly rounded.

3. The support rack of claim 1, wherein the length of each fin is not greater than the width of said fin.

4. The support rack of claim 3, wherein at least one fin has a width greater than the length of said fin.

5. The support rack of claim 4, wherein the fins disposed adjacent one arm have a width which is greater than their length, and wherein the fins adjacent the other arm have a width which is the same as their length.

6. The support rack of claim 1, wherein at least one fin is between 1/32 and 1/12 of an inch thick.

7. A support rack as defined in claim 1, wherein the fins are spaced sufficiently close to adjacent fins such that insertion of the member within the containment area will cause a plurality of the second, distal edge of the fins to contact and be pushed against the member by the midportion of a fin below.

8. A support rack for holding a member, the rack comprising:

a U-shaped member formed by two upwardly extending arms so as to define a containment area therebetween, each arm having an inner face, and a plurality of resilient fins attached to the inner face of each arm, the fins being formed of a resilient, friction enhancing material, each of said fins having (i) a first edge attached to the inner face, (ii) a second, distal edge of greater length than the first edge extending within the containment area, and (iii) a midportion between the attached first substantailly straight edge and the second distal edge of greater length which includes a substantially flat face exposed generally toward the containment area, a thickness defined by the flat face and an opposing face, and a width defined by the edge of the fin, the width being greater than the thickness, said midportion being sufficiently thin and flexible and being sized and dimensioned so that upon insertion of said member into the containment area, said midportions of said fins are diplaced to form a substantially continuous gripping surface in contact with said member to secure the member in a contained and cushioned position.

9. The support rack of claim 8, wherein each fin has a length extending from the first end to the second end, the width being greater than the length.

10. The support rack of claim 8, wherein each fin has a length extending from the first end to the second end, the fins disposed on one arm having a width greater than their length, and the fins disposed on another arm having a width equal to their length.

11. The support rack of claim 8, wherein the fins are resilient and flexible to conform to the shape of a rifle stock and inhibit inadvertent release when the rifle stock is positioned in the containment area.

12. The support rack of claim 8, wherein the second end of each fin is disposed below the first end of the fin.

13. A support rack as defined in claim 8, wherein the second edge of each fin is broadly rounded between lateral sides of the fin and within a plane of the substantially flat face.

14. A support rack as defined in claim 8, wherein the fins are spaced sufficiently close to adjacent fins such that insertion of the member within the containment area will cause a plurality of the second, distal edge of the fins to contact and be pushed against the member by the midportion of a fin below.

15. A support rack for holding a member, the rack comprising:

a frame member having first and second arms extending generally upwardly, each arm having a lower end, and a curved bottom portion connecting the lower end of each arm so as to define a containment area;

a resilient liner attached to the arms and bottom portion of the frame member about the containment area; and a plurality of elastomeric fins extending from the resilient liner adjacent the arms so as to extend into the containment area, each of said fins having (i) a first edge attached to the resilient liner, (ii) a distal edge of greater length than the first edge and a midportion between the first edge and the distal edge of greater length which includes a substantially flat face which bends;

said fins being sized and dimensioned so that upon insertion of said member into the containment area, said midportions of said fins are diplaced to form a substantially continuous gripping surface in contact with said member to secure the member in a contained and cushioned position and to conform to the member.

16. The support rack of claim 15, wherein the elastomeric fins each have a first end disposed adjacent the arms and a second end extending downwardly into the containment area.

17. The support rack of claim 15, wherein each fin has a second end disposed in the containment area, and wherein at least one of the fins has a tip being broadly rounded between the lateral sides of the fin and within a plane of the substantially flat face.

18. A method for holding a member within a generally U-shaped support rack, the method comprising the steps of:

(a) selecting a frame having a curved bottom portion and a pair of arms extending upwardly from the bottom portion so as to form a containment area;

(b) positioning a plurality of fins having a flat midportion made of an elastomeric material and disposing the fins so that they extend into the containment area of the frame, (c) inserting the member within the containment area and displacing the flat midportion of the fins to form a substantially continuous gripping surface in contact with said member to secure the member in a contained and cushioned position, the fins having sufficient flexibility and resiliency at the midportion to conform to the shape of the member.

19. The method of claim 18, wherein step (b) comprises, more specifically, selecting fins with an end being broadly rounded between the lateral sides of the fin and within a plane of the substantially flat face and disposing the fins such that the broadly rounded end contacts a stock disposed in the containment area.

20. The method of claim 18, wherein step (b) comprises, more specifically, selecting fins which have a length and a width, the width of each fin being at least as great as the length thereof.

21. The method of claim 18, wherein step (c) comprises, more specifically, sliding the rifle stock between the fins such that the stock is frictionally held between the fins.

* * * * *